United States Patent [19]

Lesher

[11] 4,392,462

[45] Jul. 12, 1983

[54] INVERTED BUCKET TAPPET WITH SEAL

[75] Inventor: Kenneth W. Lesher, Wheaton, Ill.

[73] Assignee: Stanadyne, Inc., Windsor, Conn.

[21] Appl. No.: 219,266

[22] Filed: Dec. 22, 1980

[51] Int. Cl.[3] ..... F01L 1/24

[52] U.S. Cl. ..... 123/90.55

[58] Field of Search ..... 123/90.16, 90.46, 90.55, 123/90.56, 90.57, 90.58

[56] References Cited

U.S. PATENT DOCUMENTS

| | | | |
|---|---|---|---|
| 2,484,109 | 10/1949 | Meinecke | 123/90.16 |
| 2,870,757 | 1/1959 | Dayton | 123/90.55 |
| 3,509,858 | 5/1970 | Scheibe et al. | 123/90.55 |
| 3,658,038 | 4/1972 | Bergmann | 123/90.55 |

FOREIGN PATENT DOCUMENTS

| | | | |
|---|---|---|---|
| 1808000 | 5/1970 | Fed. Rep. of Germany | 123/90.55 |
| 556610 | 10/1943 | United Kingdom | 123/90.56 |

*Primary Examiner*—Craig R. Feinberg
*Assistant Examiner*—W. R. Wolfe
*Attorney, Agent, or Firm*—Kinzer, Plyer, Dorn & McEachran

[57] ABSTRACT

A compact self-compensating hydraulic lash adjuster (tappet) particularly suited for use in internal combustion engines having overhead cams. A flexible rubber member forms a one-way valve and seal thereby creating a reservoir of hydraulic fluid. This reservoir instantaneously provides the necessary hydraulic fluid for proper tappet operation, even after sustained periods of engine shut-down. A hydraulic compression chamber is contained in a piston assembly positioned within the center of the overall tappet assembly. This construction facilitates the substitution of piston assemblies of varying axial dimension thereby permitting the basic structure to be used in engines having differing tappet length requirements.

3 Claims, 2 Drawing Figures

Fig. 1.
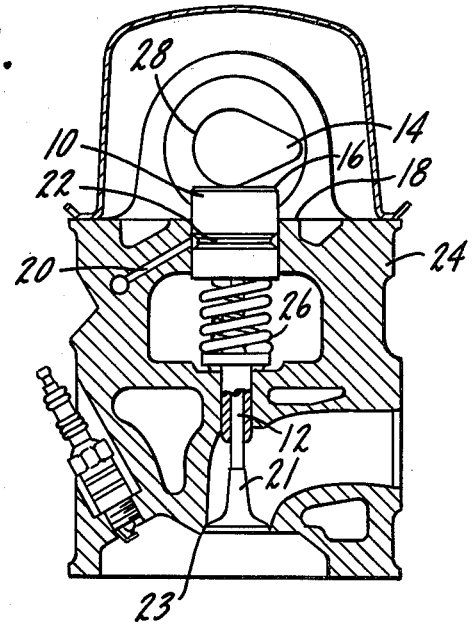
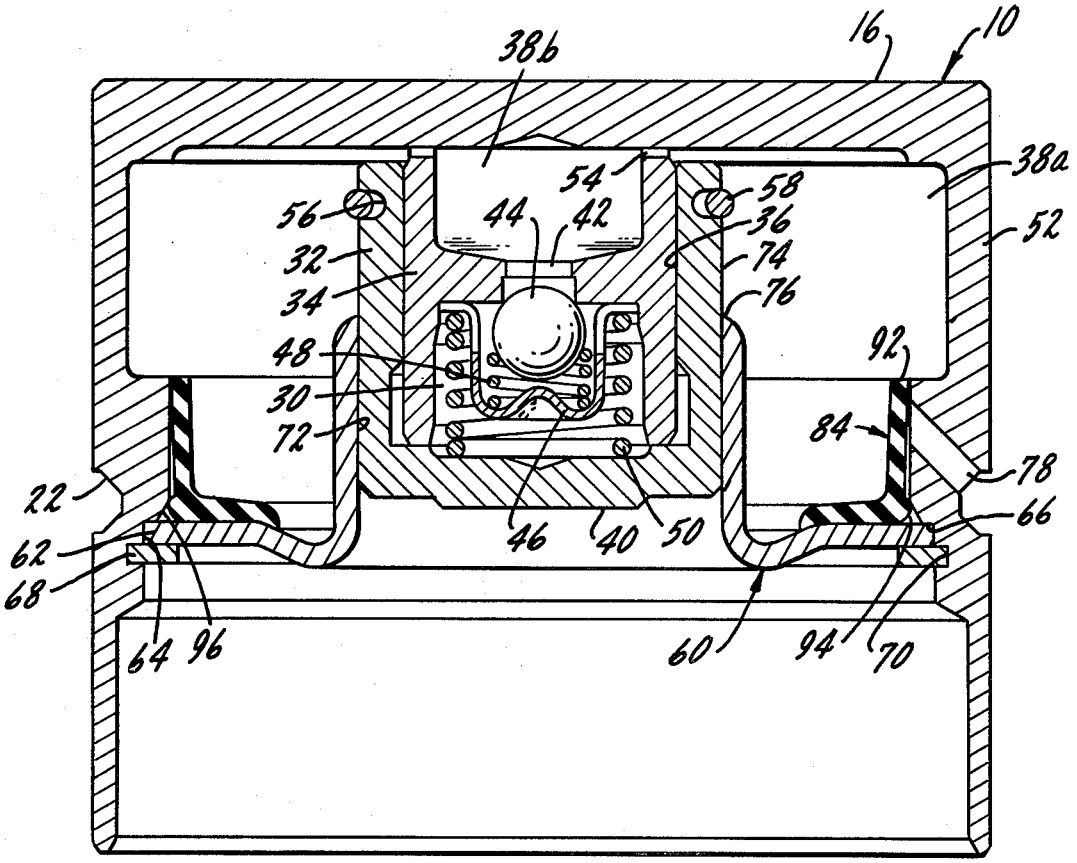
Fig. 2.

INVERTED BUCKET TAPPET WITH SEAL

SUMMARY OF THE INVENTION

The present invention relates to hydraulic lash adjusters (tappets) and in particular to a compact lash adjuster suitable for use in modern overhead cam engines. In this environment engine oil must enter the tappet through a passageway located in the lower or mid portion of the tappet. This invention includes a flexible rubber-like seal which permits engine oil to enter the tappet, thereby forming a reservoir of hydraulic fluid, while blocking the subsequent release of such fluid. In this manner a permanent supply of hydraulic fluid is available for proper tappet operation particularly following a prolonged period of engine shut-down.

The hydraulic compression chamber is contained in a piston assembly which is positioned in the center of the overall tappet. Interchangeable piston assemblies of various lengths may be substituted thereby providing an inexpensive and flexible technique for creating a family of tappets suitable for use in a variety of engines.

A primary purpose of this invention is a compact tappet having a source of hydraulic fluid other than at the top and having a reservoir of hydraulic fluid immediately available even following periods of engine shut-down.

Another purpose is a flexible rubber-like seal which permits the entry of hydraulic fluid as required into a reservoir within the tappet during periods of engine operation while blocking the subsequent loss of such reservoir fluid particularly when the engine is shut-down.

Another purpose is a compact tappet suitable for use in modern compact engines having overhead cams, particularly where the tappet is positioned immediately between the valve stem and the cam.

Another purpose is a tappet having interchangeable piston assemblies thereby facilitating an inexpensive method for the creating of a family of tappets.

Other purposes will appear in the ensuing specification, drawings, and claims.

BRIEF DESCRIPTION OF THE DRAWINGS

The invention is illustrated diagrammatically in the following drawings wherein:

FIG. 1 is a cross section view of the upper cylinder region of an overhead cam engine utilizing the lash adjuster of this invention; and FIG. 2 is an axial section through a lash adjuster of the type described.

DESCRIPTION OF THE PREFERRED EMBODIMENT

The invention described herein relates to a self-compensating hydraulic lash adjuster ("tappet"). Specifically, this invention discloses a valve-like sealing member which functions to admit hydraulic fluid to an internal adjuster reservoir but precludes return or draining of this reservoir during engine shut-down.

Self-compensating hydraulic lash adjusters have been known to the art for many years. Most conventional adjusters contain a cylindrical plunger or body which is inserted into and is permitted to slide axially within a larger cylindrical follower member. A hydraulic fluid compression chamber is thereby formed between these members. A second fluid chamber or reservoir is usaully formed within the cylindrical interior of the plunger body, the fluid level of this reservoir being maintained by a supply of engine lubricant through appropriate channels and cavities. A biasing spring is provided which forces the plunger body outwardly from the follower housing when no external restaining forces are applied. This relative movement causes a oneway check valve located at one end of the plunger body to open thereby permitting hydraulic fluid to pass from the fluid reservoir into the hydraulic chamber as the volume of that chamber increases. A more complete description of this type of adjuster is provided below.

Conventional adjusters of this type typically utilize relatively long members, particularly the plunger body. This facilitates the inclusion of a significant fluid reservoir within the plunger which is fed from a source of motor oil at the adjuster's upper portion. Conventional adjusters are designed and mounted so that the fluid pumped into the fluid reservoir during engine operation remains in that reservoir upon shut-down. This is a necessary and desirable feature in that adjusters often require additional fluid immediately upon engine start up. This fluid will be instantaneously available in a conventional adjuster through the check valve from the adjacent fluid reservoir. In the absence of a fluid reservoir, however, or in the event that such reservoir has drained during shut-down periods, new fluid will not be available to the adjuster until the engine develops sufficient oil pressure and again pumps fluid to the adjuster. The absence of an available hydraulic fluid reservoir can result in improper adjuster length compensation for a considerable period of time upon start up, particularly in cold ambient temperatures.

With the advent of small efficient internal combustion engines and with the increased utilization of overhead cams, hydraulic lash adjusters of considerably smaller axial dimension have been mandated. Further, the placement of such adjusters within the valve train often makes it difficult or impossible to supply oil to the upper-most portion of the adjuster. FIG. 1 illustrates such a modern compact adjuster 10 positioned axially above its respective valve 21 and immediately below the overhead cam 14. In this configuration the top portion 16 of adjuster 10 extends substantially above the engine cylinder casting 18 through which oil galleys and channels 20 are formed. As a consequence, hydraulic fluid or engine oil must enter adjuster 10 at a point 22 well below the upper-most portion of the adjuster. This invention discloses a self-compensating hydraulic lash adjuster of small physical dimension and a device for maintaining a reservoir of hydraulic fluid during periods of engine shut-down.

FIG. 2 illustrates the complete lash adjuster or "tappet" of this invention. A high pressure hydraulic chamber 30 is formed between a cylindrical cup-shaped body 32 and cylindrical plunger 34. Body 32 and plunger 34 are dimensioned so as to permit relative axial movement between these members. Further, the relative diameters of these members are chosen so that a small and predetermined quantity of hydraulic fluid is permitted to escape from compression chamber 30 into the hydraulic fluid reservoir **38*a* along the cylindrical interface surface 36 whenever a compressive force is applied on body 32 with respect to plunger 34**.

A boss 40 is formed on the lower portion of the body 32 which will receive and contact the valve stem during normal engine operation. An annular groove 56 is provided on the upper portion of body 32 to receive a retaining ring 58 which may be of the slotted compression type. Retaining ring 58 blocks the unrestrained downward movement of body member 32 thereby guaranteeing that the compete tappet, once assembled, remains an integral unit during engine assembly and, subsequently, during engine operation. Slot 56 is dimensioned so as to receive the entire cross section of retaining ring 58 thereby permitting the unrestrained insertion of body 32 into the tappet structure.

A hydraulic metering orifice 42 is provided on the center axis of plunger 34 through which hydraulic fluid is permitted to pass from the reservoir 38*b* to the compression chamber 30 whenever the check valve is open. The check valve is comprised of an orifice blocking check ball 44, a check ball retainer 46, and a biasing coil spring 48. Check ball 44 is normally held in its closed position as shown by the force of biasing spring 48 acting against ball retainer 46 or by the pressure of the hydraulic fluid within compression chamber 30 whenever a compressive axial force is applied to the tappet. Ball retainer 46 is provided with several openings or perforations to permit the free flow of hydraulic fluid within compression chamber 30 both above and below the retainer clip. A second and larger coil spring 50 functions to rigidly hold ball retainer 46 against plunger 34.

A second and principal function of coil spring 50 is to provide an axial biasing force between body 32 and plunger 34 thereby forcing these members into relative axial expansion. This expansion continues as the plunger 34 contacts the follower 52 which, in turn, forces the body 32 downward or outward in relation to the overall tappet assembly until the assembly engages, simultaneously, the valve stem on the bottom and the cam on the top. Slots 54 are spaced along the annular top portion of plunger 34 to facilitate the free flow of hydraulic fluid from the outer fluid reservoir 38*a* to the inner reservoir 38*b*.

Body 32, plunger 34, biasing spring 50, and the check valve components described above form an integral piston assembly which, by compressing retaining spring 58, is inserted into the overall tappet structure. This geometry permits piston assemblies of varying lengths to be inserted into a single common tappet structure. As a consequence, a family of tappets adapted to engines having differing tappet length requirements has been created merely by providing a series of piston assemblies which can be inserted into a common overall tappet structure.

This piston assembly is positioned within the center of an annular L-shaped spacer 60 containing a flange 62 along its outside perimeter. This flange is positioned along an indented portion 64 of the interior cylindrical surface of follower 52 so as to engage the non-indented stop at 66. Spacer 60 is held in this position by an annular retaining ring 68 inserted into annular slot 70. The inside cylindrical surface 72 of spacer 60 forms a close but non-interfering fit with the outside surface 74 of body 32. Body 32 is free to move upwardly to the limits permitted by the axial dimension of plunger 34 and downwardly until retaining ring 58 engages the upper surface 76 of spacer 60. Engine oil within reservoir 38*a* will lubricate the sliding joint between the body and spacer members but the close fit between these members precludes any significant loss of oil through this interface. In a similar manner fluid will not escape past flange 62.

The outer body or follower 52 of this hydraulic lash adjuster is a cylindrical cup-shaped member closed at the top and open at the bottom. The interior surface including an indented portion 64, a stop 66, and a slot 70 was described above. The outer diameter of follower 52 is selected so that the entire tappet assembly establishes, as shown in FIG. 1, a close but non-interfering fit with cylinder block 24. A V-shaped annular groove 22 is formed around the outside perimeter of follower 52. This groove is located so as to be in communication with a source of engine lubrication 20 as shown in FIG. 1. A passage 78 is provided through the follower side wall thereby permitting the flow of fluid from the exterior groove 22 into the internal fluid reservoir 38*a*.

An annular sealing member is positioned between spacer 60 and follower 52. Sealing member 84 is formed in place on spacer 60, and the dimension of surface 94 on sealing member 84 is such that when assembled into its final configuration the contact of surface 94 with surface 96 on follower or effects a snug compression fit assuring proper rotation and prevents fluid leakage between surfaces 94 and 96. This contact point is substantially below the opening of passage 78 into fluid reservoir 38*a*. Thus it will not block the flow of engine oil into reservoir 38*a*. An upper finger-like portion 92 of member 84 is biased against the interior wall of follower 52 thereby precluding the flow of oil from reservoir 38*a* outwardly through passage 78. Any outward pressure from within the fluid reservoir acts to increase the force acting upon member 84 thereby assuring an even tighter engagement between this member and follower 52. On the other hand, orientation of rubber member 84 is such that a positive fluid pressure acting through passage 78 upon rubber member 84 easily moves finger-like portion 92 away from the wall thereby admitting additional hydraulic fluid to reservoir 38*a*.

The self compensating hydraulic lash adjuster or "tappet" of this invention is installed and functions as follows. The tappet is positioned as shown in FIG. 1 within a cylindrical opening in cylinder block 24. The tappet is properly located when the top of valve stem 12 engages the boss 40 on body 32 of the tappet. The cam shaft assembly including cam 14 may then be assembled above the tappet.

Tappets may be supplied in either a "dry" or a "wet" form. A "dry" tappet is one containing no hydraulic fluid while a "wet" tappet is precharged at the time of manufacture with a quantity of hydraulic fluid. Since "dry" tappets quickly fill with hydraulic fluid in the manner described below upon initial engine start-up, only "wet" tappets will be considered at this point.

If the tappet as supplied contains the proper quantity of hydraulic fluid, the upper surface 16 of the tappet should just contact the circular portion 28 of the cam 14. This assumes that valve 21 is properly seated at 23 within the cylinder. The top of valve stem 12 will be in contact with boss 40 on tappet body 32. In this condition, there will be no play or "lash" between the tappet and either the cam 14 or the valve stem 12.

If, on the other hand, the tappet is precharged with an excess amount of fluid in compression chamber 30, the bottom portion 40 of tappet body 32 will force valve 21 downward so that it no longer seats at 23. In this condition, valve spring 26 exerts a upward or compressive force through valve stem 12 on tappet body 32. However, upward movement of the entire tappet assembly is precluded as the upper tappet surface 16 is in contact with the rigidly mounted and stationary cam 14. Instantaneous compression of the tappet piston assembly, thereby allowing the valve to seat, is precluded by the non-compressibility of the hydraulic fluid within chamber 30. Further, hydraulic fluid cannot escape through passage 42 as the increased hydraulic pressure augments the force created by check spring 48 thereby maintaining check ball 44 in tight blocking engagement with the orifice and passage 42.

The narrow cylindrical passage 36 between plunger 34 and body 32, however, does provide a slow means of escape for the fluid trapped in compressive chambers 30. Over a period of time the fluid escaping between these members permits the slow contraction of the tappet ultimately allowing valve 21 to seat at 23. Upon proper seating, the force of valve spring 26 acting on the tappet ceases which, in turn, terminates the gradual loss of hydraulic fluid from compression chamber 30. The tappet has now properly self-adjusted. The upper tappet surface 16 is in engagement with the circular portion 28 of cam 14 while the valve stem 12 is in contact with the lower portion 40 the tappet body 32.

Finally, if the tappet is precharged with an insufficient quantity of hydraulic fluid, the upper tappet surface 16 will not be in contact with the cam when the tappet is resting upon a properly seated valve.

In such event, biasing spring 50, which acts upon plunger 34 and, in turn, upon follower 52, forces the follower upwardly until it engages the cam. In order that this occur, however, additional hydraulic fluid must enter pressure chamber 30 in an amount corresponding to the increased volume of that chamber. The check valve functions as follows to admit this fluid. As the piston assembly attempts to expand, the hydraulic pressure within the compression chamber drops as compared to that of the adjacent fluid reservoir by an amount sufficient to overcome the force of check spring 48 acting upon check ball 44. The check ball then moves from tight engagement with orifice 42 thereby admitting the requisite fluid to the pressure chamber. This expansion continues only until the upper tappet surface 16 contacts the cam. At the instant of contact, further expansion ceases as the relatively weaker biasing spring 50 can not overcome the valve spring 26 which is required to unseat and force valve 21 downwardly.

In this manner, the hydraulic lash adjusters of this invention automatically adjust to properly fill any gap or "lash" while permitting the valve to properly seat. Although the above discussion was predicated upon the assumption that the engine was not in operation, the functioning of this tappet is substantially the same during normal engine operation.

Proper engine operation requires that the eccentric rotational motion of the cam be transmitted through the tappet to the corresponding valve thereby forcing it open. In order that this transfer occur, the tappet must maintain its axial dimension, that is, it can not substantially compress during any given valve opening. Such compression would allow the valve to close thereby impeding the free flow of gasses through the open valve aperture.

The tappet herein does, as discussed above, anticipate or permit some size reduction during tappet compression cycles by reason of fluid leakage at interface 36. This does not represent a limitation, however, as significant leakage requires sustained compression for durations in excess of several seconds. Thus, for example, a 50 pound compressive force sustained between 5 and 25 seconds causes only 0.05 inch axial compression of the tappet. During normal engine operation a valve remains open typically for less than a tenth of one second. Such short compressive intervals cause only insignificant tappet compression. By contrast, the tappet can expand almost instantaneously by reason of the relatively large cross sectional area of orifice 42. This permits the tappet to correct instantaneously as required for any axial contraction however minimal it may be. For this reason, successive losses of pressure chamber fluid do not accumulate. Each individual loss is replenished as soon as the valve has again closed.

Whereas the preferred form of the invention has been shown and described herein, it should be realized that there may be modifications, substitutions and alterations thereto.

The embodiments of this invention in which an exclusive property or privilege is claimed are defined as follows:

1. In a self-compensating hydraulic lash adjuster, a cup-shaped follower, a body supported thereon, a spacer attached to said follower and supporting said body, said spacer, body and follower defining a fluid reservoir, a piston assembly positioned within said body and defining a compression chamber therewith, check valve controlled passage means between said reservoir and compression chamber, a fluid passage in said follower opening into said reservoir, and a somewhat L-shaped elastomeric seal seated upon said spacer and masking said fluid passage, the upright portion of said L-shaped elastomeric seal functioning to admit hydraulic engine fluid through said passage to said fluid reservoir, to block the reverse flow through said passage from said reservoir, and to seal against the leakage of fluid from said reservoir between said spacer and follower, the base of said L-shaped elastomeric seal being seated upon and supported by said spacer.

2. In a self-compensating hydraulic lash adjuster having a cylindrical hydraulic compression chamber; a unidirectional fluid check valve positioned at one end of said compression chamber so as to control the passage of fluid thereto; a cylindrical fluid reservoir in communication with said compression chamber through said check valve; and a passage between the adjuster exterior and said fluid reservoir through which engine oil may flow as required, the improvement comprising a second check vlave which functions to admit hydraulic engine fluid to said fluid reservoir, to block the reverse flow through said passage from said fluid reservoir and to seal against the leakage of fluid from said fluid reservoir, said second check valve including a flexible annular ring having a diameter approximately equal to, or slightly larger than, the diameter of said fluid reservoir at its point of connection to said passage and further characterized in that said flexible ring is biased against a wall of said fluid reservoir at said point of passage connection so as to be in blocking engagement with said passage opening and further characterized in that positive engine oil pressure acting upon said flexible ring through said passage causes said flexible ring to deform thereby admitting engine oil into said fluid reservoir and that a positive fluid pressure within said fluid reservoir forces said flexible ring into tighter blocking engagement with said fluid reservoir wall thereby further blocking the flow of hydraulic fluid from said fluid reservoir, said flexible ring having a portion positioned against said reservoir wall surrounding said passage, and a support portion extending generally inwardly from said wall portion, and being supported by a portion of said fluid reservoir.

3. The lash adjuster of claim 2 further characterized by and including a support member forming a portion of said the fluid reservoir, with said annular ring support portion being positioned upon said support member.

* * * * *